United States Patent [19]

Barriac

[11] Patent Number: 4,801,030

[45] Date of Patent: Jan. 31, 1989

[54] TAMPER-INDICATING CLOSURE AND PACKAGE

[75] Inventor: Jacques J. Barriac, Toledo, Ohio

[73] Assignee: Owens-Illinois Closure Inc., Toledo, Ohio

[21] Appl. No.: 95,793

[22] Filed: Sep. 14, 1987

Related U.S. Application Data

[63] Continuation-in-part of Ser. No. 54,964, May 28, 1987, abandoned.

[51] Int. Cl.[4] ..... B65D 41/34

[52] U.S. Cl. ..... 215/252; 215/258

[58] Field of Search ..... 215/252, 253, 256, 258

[56] References Cited

U.S. PATENT DOCUMENTS

| | | | |
|---|---|---|---|
| 4,470,513 | 9/1984 | Ostrowsky | 215/252 |
| 4,478,343 | 10/1984 | Ostrowsky | 215/252 |
| 4,493,427 | 1/1985 | Wolkonsky | 215/258 X |
| 4,546,892 | 10/1985 | Couput | 215/252 |
| 4,613,052 | 9/1986 | Gregory et al. | 215/252 |
| 4,653,657 | 3/1987 | Paparasilopoulos | 215/252 |

*Primary Examiner*—Stephen P. Garbe
*Assistant Examiner*—Nora Stucker

[57] ABSTRACT

A tamper-indicating closure and package comprising a one-piece molded closure of plastic which threads onto a container such that when the closure is unthreaded, a tamper-indicating band becomes separated from the lower end of the closure skirt. The tamper-indicating band is joined to the closure along a weakened frangible line. A flexible annular wall is formed within the band and extends inwardly and upwardly when the closure is applied to container finish. The band further includes a plurality of circumferentially spaced flexible walls extending circumferentially and fastened at their circumferential ends to the inner surface of the annular wall and having portions intermediate their ends which extend radially inwardly. When the closure is applied to the container, the intermediate portions of the circumferentially extending walls are flexed radially outwardly intermediate their ends over the annular bead on the container and then flex radially inwardly beneath the annular bead while the annular wall is interposed between the skirt of the closure and the annular bead on the container. When the closure is unthreaded, the upper edges of the circumferentially spaced circumferential walls engage the underside of the bead and cause the band to sever along the weakened line.

24 Claims, 10 Drawing Sheets

TAMPER-INDICATING CLOSURE AND PACKAGE

This application is a continuation-in-part of my earlier application, Ser. No. 54,964, filed May 28, 1987, entitled "Tamper-Indicating Closure and Package," now abandoned.

This invention relates to temper-indicating closures and packages.

BACKGROUND AND SUMMARY OF THE INVENTION

It has heretofore been suggested that a tamper-indicating band be connected to a closure, the band having flexible portions that are deflected over an annular bead on the container and under the annular bead such that when the closure is unthreaded from the container, the flexible portions cause the band to be severed along a weakened line from the remainder of the closure indicating that the closure has been opened.

In U.S. Pat. Nos. 4,550,844 and 4,613,052, having a common assignee with the present application, there is disclosed and claimed a screw type cap of plastic with a tamperindicating ring or band that is carried at the lower end of the skirt of the closure with frangible bridges forming the connection. The removal of the closure results in the tamper indicating band being severed from the closure and the band is moved to a lower position on the neck and is prevented from being returned to its as applied position. A container has a finish, below external threads which is formed with an inwardly and downwardly tapering side wall which leads to an abrupt, horizontal ledge such that when an indicating band is severed from a closure, on removal, the band falls below the ledge and cannot be returned. The closure is formed with internal threads in the skirt and at the bottom of the skirt a band or ring of about the same external diameter as the cap is formed with frangible bridges joining the band to the skirt. Within the indicating band, an inwardly extending flexible stop ring is formed integral with the indicating band. A particular finish on the container provides a pair of radial ledges which extend outwardly below the threads on the container neck. These ledges are vertically displaced relative to each other and are joined by an inwardly tapering wall which is adapted to form the surface on which the stop ring will be seated when the closure is applied. The stop ring prevents removal of the closure without the separation of the indicating band from the closure skirt.

In U.S. patent application Ser. No. 820,034, filed Jan. 21, 1986, and having a common assignee with the present application, there is disclosed a tamper indicating package comprising a container having a neck with a threaded finish and a closure which includes a base wall and depending peripheral skirt having threads interengaging the threads of the container, and a tamper indicating band attached to the skirt by a plurality of circumferentialy spaced frangible bridge members. The tamper indicating band includes a bead for engaging a complementary bead on the container, and a segmented annular flange extending axially upwardly and inwardly from the lower edge of the tamper indicating band towards the base wall of the closure. The annular flange has its free edge formed with a plurality of segments such that the stiffness of the flange is reduced. In addition, the leading end of each segment is cut to a 30° angle. These two features facilitate the application of the closure to the container.

In U.S. Pat. No. 4,546,892, there is disclosed a plastic tamper indicating closure which has an annular wall extending upwardly and inwardly and an annular bead or heel along the inner surface of the wall so that when the closure is applied to a container, the annular wall is interposed between the skirt of the closure and the finish of the container and the bead engages the underside of the ring on the finish to hold the closure in position.

In tamper indicating packages which utilize closures that have flexible portions associated with the tamper indicating band, when such closures are utilized with glass containers that have a wide range of tolerances, it is sometimes difficult to insure that proper clearance will be provided. In addition, because of the flexibility of the portions, there may be concern that somehow a user might attampt to deflect the portions in order to remove the closure and thereby defeat the purpose.

Accordingly, among the objectives of the present invention are to provide a tamper-indicating closure and package which will provide a tamper evident feature which is more reliable over a wider range of finish tolerances and which is much more difficult to defeat than certain plastic closures that have plural flexible portions that engage the container.

In accordance with the invention, a tamper-indicating closure and package comprising a one-piece molded closure of plastic which threads onto a container such that when the closure is unthreaded, a tamper-indicating band becomes separated from the lower end of the closure skirt. The tamper-indicating band is joined to the closure along a weakened frangible line. A flexible annular wall is formed within the band and extends inwardly and upwardly when the closure is applied to container finish. The band further includes a plurality of circumferentially spaced flexible walls extending circumferentially and fastened at their circumferential ends to the inner surface of the annular wall and having portions intermediate either ends which extend radially inwardly. When the closure is applied to the container, the intermediate portions of the circumferentially extending walls are flexed radially outwardly intermediate their ends over the annular bead on the container and then flex radially inwardly beneath the annular bead while the annular wall is interposed between the skirt of the closure and the annular bead on the container. When the closure is unthreaded, the upper edges of the circumferentially spaced circumferential walls engage the underside of the bead and causes the band to sever along the weakened line.

DESCRIPTION

Figure 1:
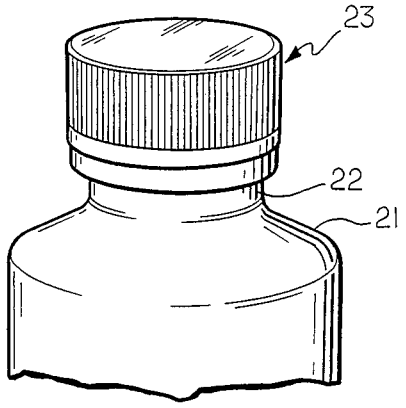
FIG. 1 is a fragmentary perspective view of a tamper indicating package embodying the invention.
Figure 2:
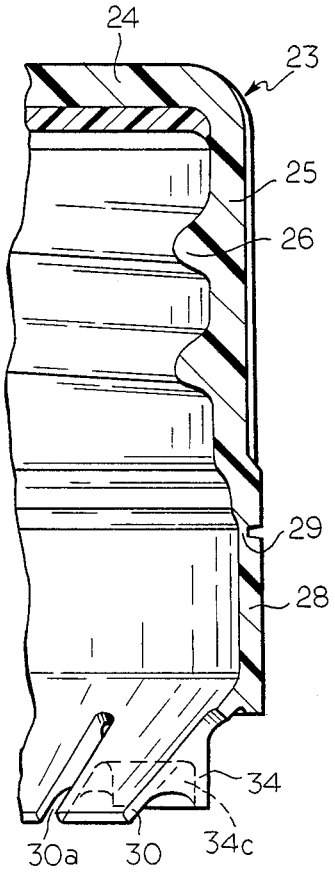
FIG. 2 is a vertical sectional view through a closure embodying the invention after it has been molded.
Figure 3:
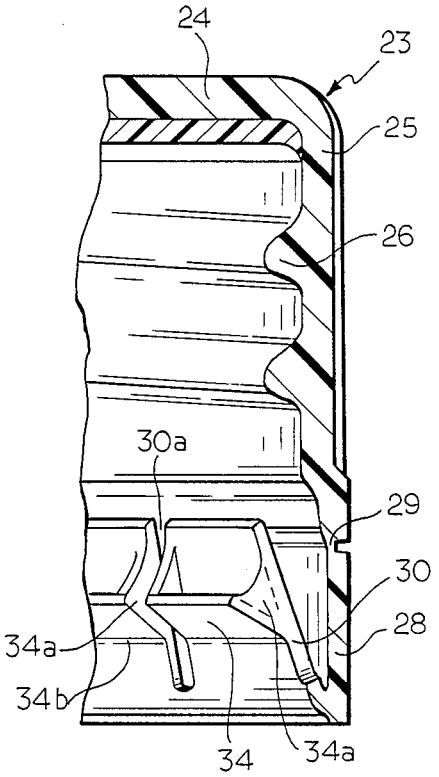
FIG. 3 is a view similar to FIG. 2 showing the closure after it has been reshaped for application to a container.
Figure 4:
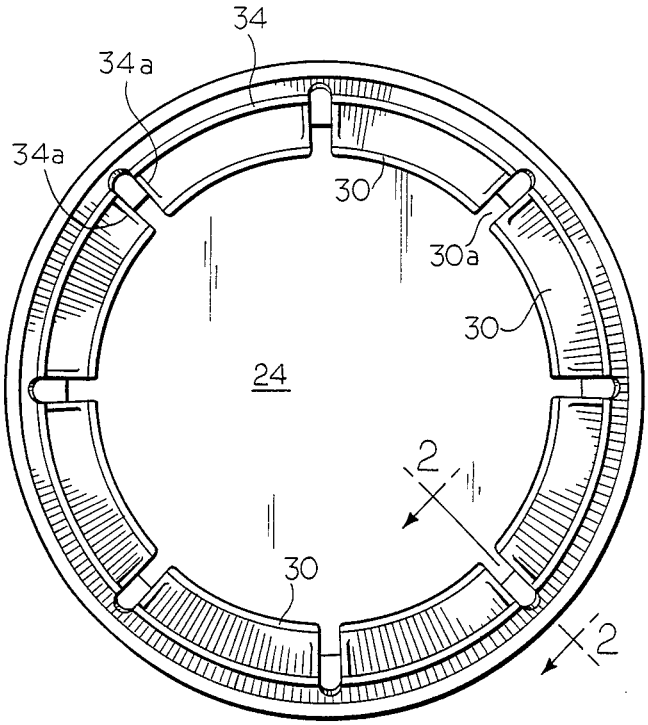
FIG. 4 is a bottom plan view of the closure shown in FIG. 2.
Figure 5:
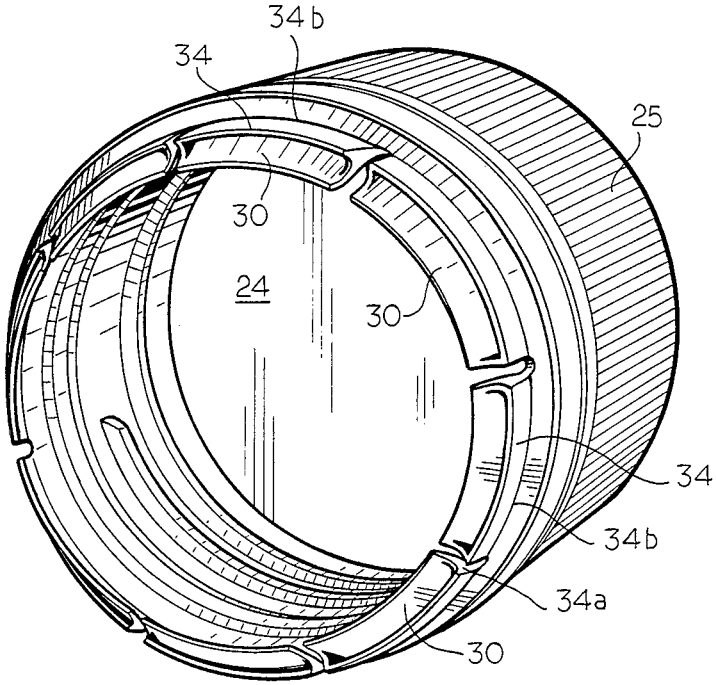
FIG. 5 is a perspective view of the closure shown in FIGS. 2 and 4.

Referring to FIG. 1, the tamper indicating package embodying the invention comprises a glass container 21 having a finish or neck 22 and a closure 23 formed of a thermoplastic material, such as polypropylene, molded as a single unit and comprising a generally flat base 24 and a cylindrical depending skirt 25. The inner surface of the skirt 25 is formed with threads 26 which are adapted to interengage complementary threads 27 on the finish 22 (FIG. 4). As molded, a tamper indicating band 28 extends downwardly from the skirt 25 (FIGS. 2, 4 and 5) and is connected to the skirt by a weakened line defined by frangible bridges 29. An annular wall 30 extends downwardly and axially away from the base 24 of the closure 23, as formed, and has an inner surface 31 and an outer surface 32. A plurality of circumferentially spaced flexible walls 34 are provided and extend circumferentially of the closure 23 on the outer surface 32 of the wall 30. Walls 34 are joined to wall 30 along their circumferential edges by radial walls 34*a*. The portions of the walls 34 intermediate their ends extend radially inwardly to define a pocket 35 and a free edge 36. The walls 34*a* extend axially and the lower edge 34*b* of each wall 34 extends transversely in a radial plane to the wall 30. After the closure 23 is formed by molding and preferably while still hot, the wall 30 is inverted so that it extends upwardly and radially inwardly toward the base 24 bringing the circumferential walls 34 so that they also extend radially upwardly and inwardly toward the base 24 and surface 32 becomes the inner surface of the wall of the closure in use. The free edge 36 thereby faces axially toward the base 24 (FIG. 3).

Figure 6:
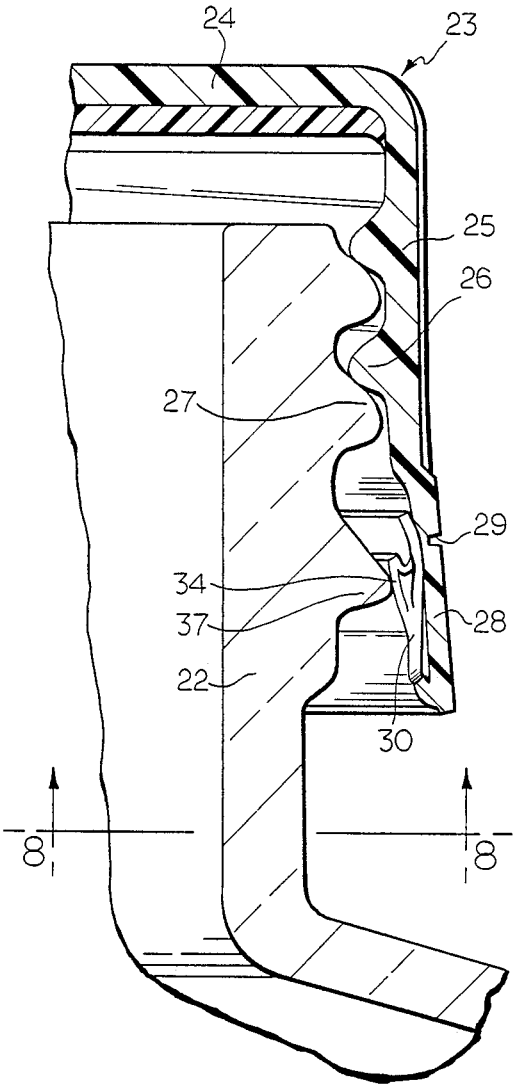
FIG. 6 is a fragmentary vertical sectional view showing the closure being applied to a container.
Figure 7:
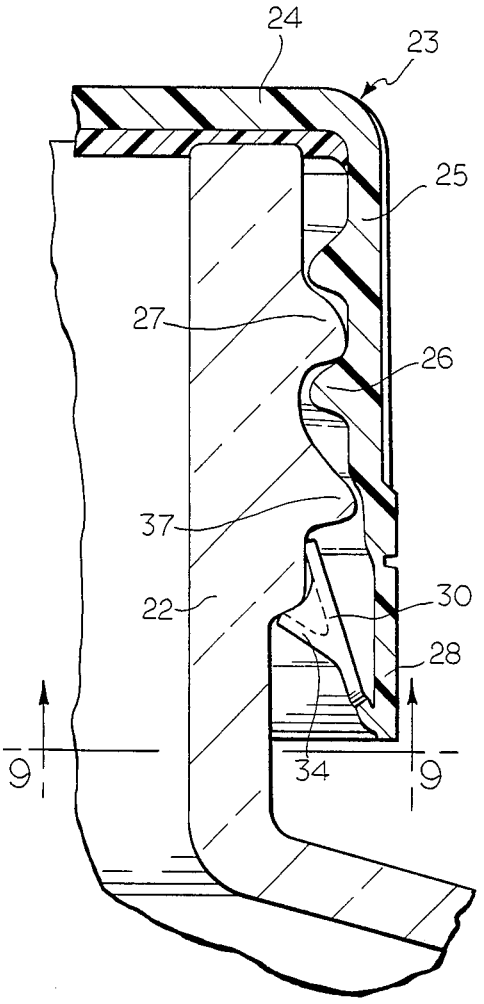
FIG. 7 is a fragmentary vertical sectional view showing the closure after it has been applied to a container.
Figure 8:
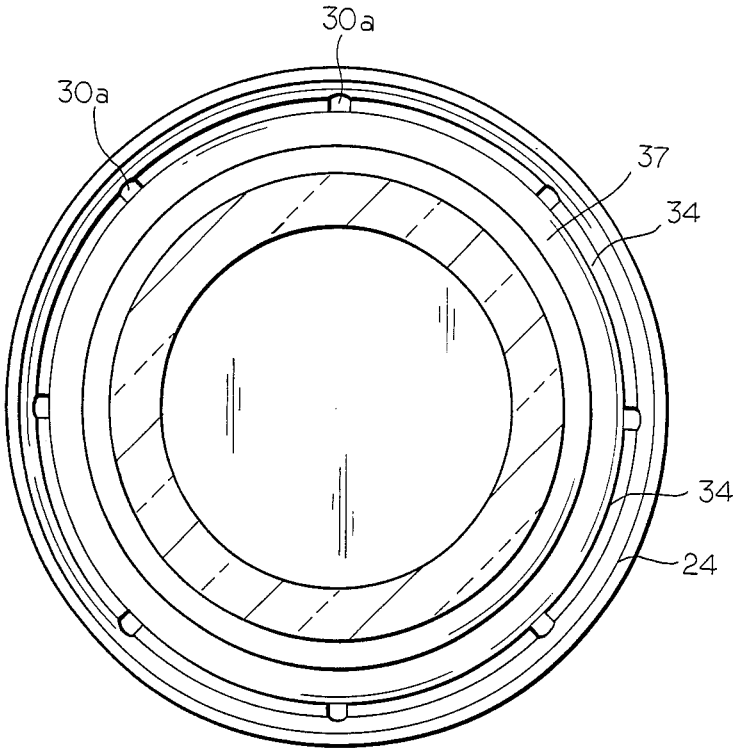
FIG. 8 is a sectional view of the closure and container taken along the line 8—8 in FIG. 6.
Figure 9:
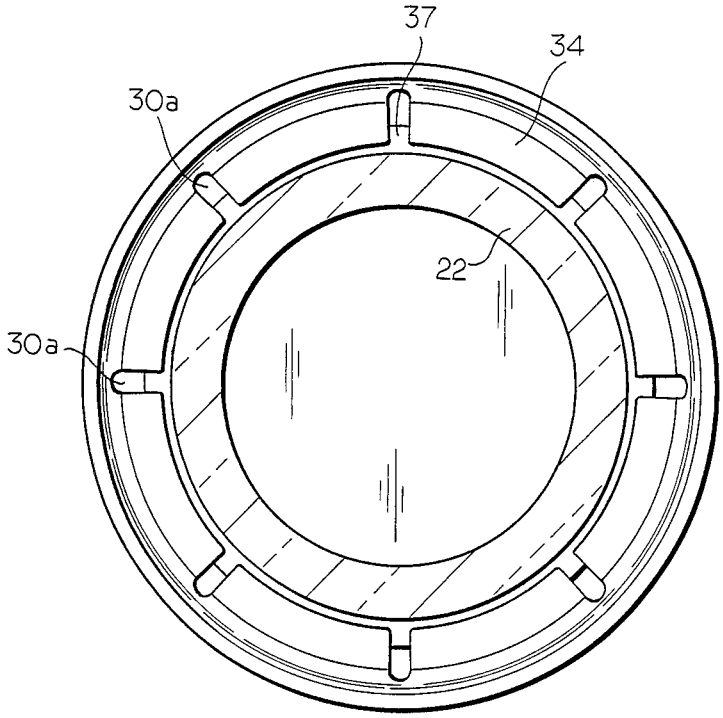
FIG. 9 is a sectional view taken along the line 9—9 in FIG. 7.

When the closure 23 is applied as shown in FIG. 6, the wall 30 is defomred so that it extends generally axially along the inner surface of the skirt and the flexible walls 34 are deflected radially outwardly intermediate their ends by the annular bead 37, as shown in FIGS. 6 and 8, over an annular bead 37 on the finish 22. As the closure 23 is threaded on the container, the flexible walls 34 pass over the bead and flex radially inwardly beneath the bead 37 while the wall 30 remains interposed between the neck 22 and the inner surface of the skirt 25 as shown in FIGS. 7 and 9. In order to facilitate application of the closure, the wall 30 is provided with axially extending slots 30*a* which extend from the free edge of wall 30 toward the junction of wall 30 and the band.

The wall 30 is preferably provided with circumferentially spaced axial slots 30*a* adjacent its free edge to facilitate application of the closure. The wall portions 34*a* preferably extend along radial axial planes.

Figure 10:
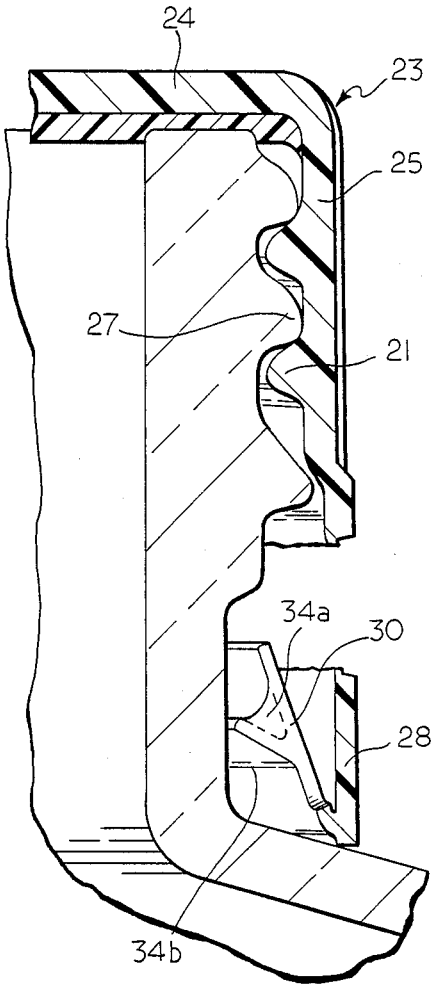
FIG. 10 is a fragmentary vertical sectional view showing the closure, band and container whern the band is severed.

Referring to FIG. 10, when the closure 23 is unthreaded, the engagement of the flexible walls 34 with the bead 37 causes the band 28 to be severed from the skirt 25 along the weakened line formed by the bridges 29 and the band 28 falls away downwardly over the bead 37 onto the neck of the container as shown in FIG. 10.

Figure 11:
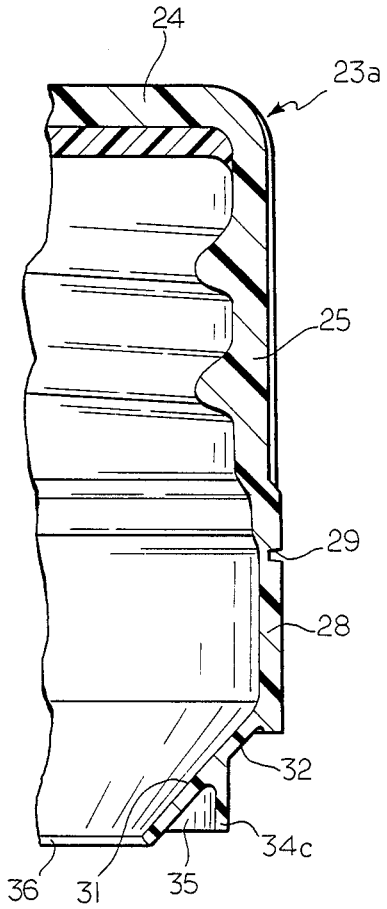
FIG. 11 is a vertical sectional view similar to FIG. 2 of a modified form of closure.

In the form set forth in FIG. 11, the closure 23*a* includes walls 34*c* which comprise flexible walls connected at their circumferential ends and lower edges to the wall 30*a*. More specifically walls 34*b* are arcuate, as contrasted to the walls 34, 34*a* of the form of closure shown in FIGS. 2–10.

In the form of closure shown in FIGS. 12–18, the closure 23*b* has walls 34*d* that are V-shaped in transverse cross sections with the apex of the V extending toward the junction with wall 30*a*.

Figure 13:
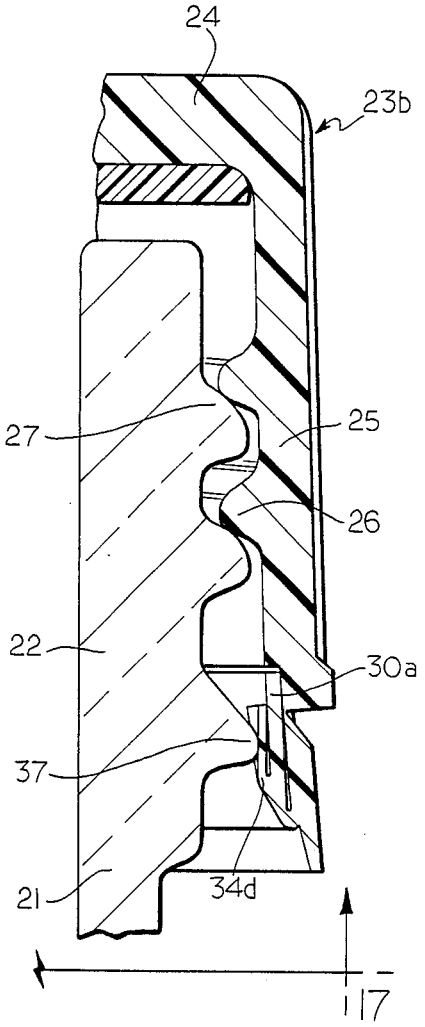
FIG. 13 is a vertical sectional view of the reshaped closure shown in FIG. 12 being applied to a container.
Figure 14:
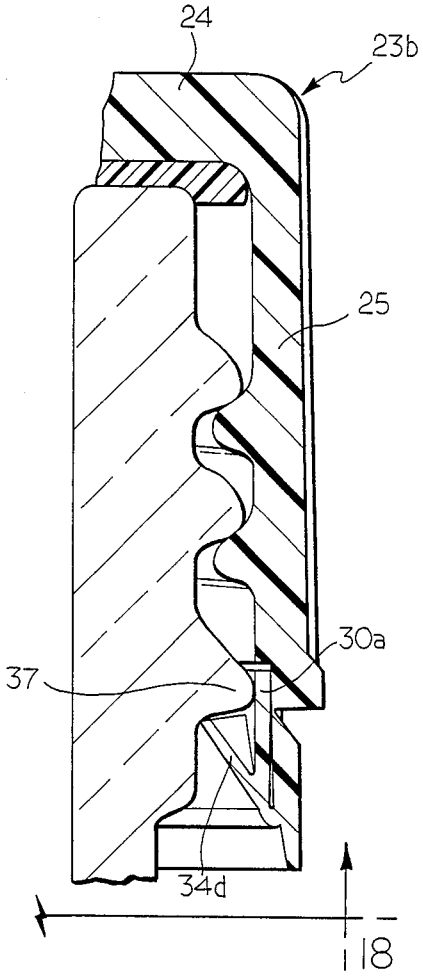
FIG. 14 is a sectional view showing the closure after it has been applied to a container.
Figure 15:
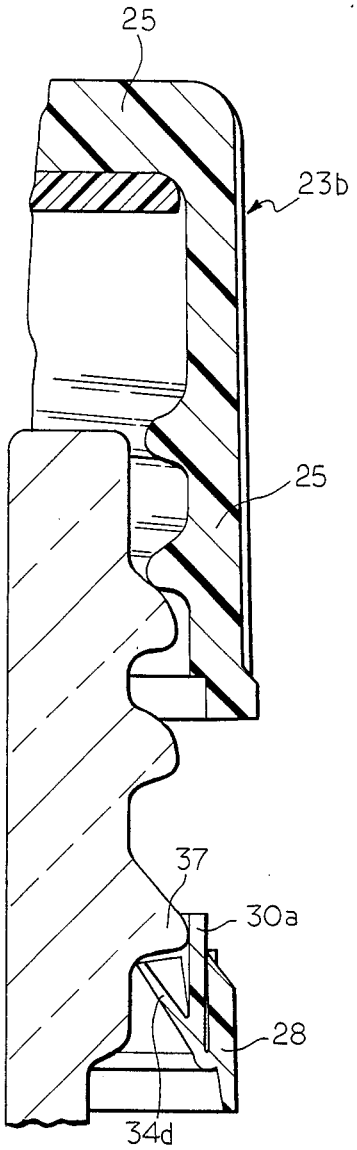
FIG. 15 is a sectional view showing the closure, band and container after the band has been severed.
Figure 16:
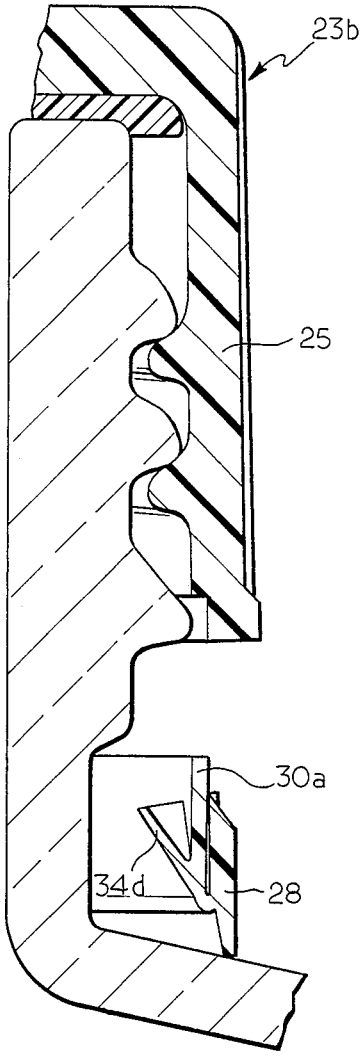
FIG. 16 is a sectional view showing the closure reapplied to the container.
Figure 17:
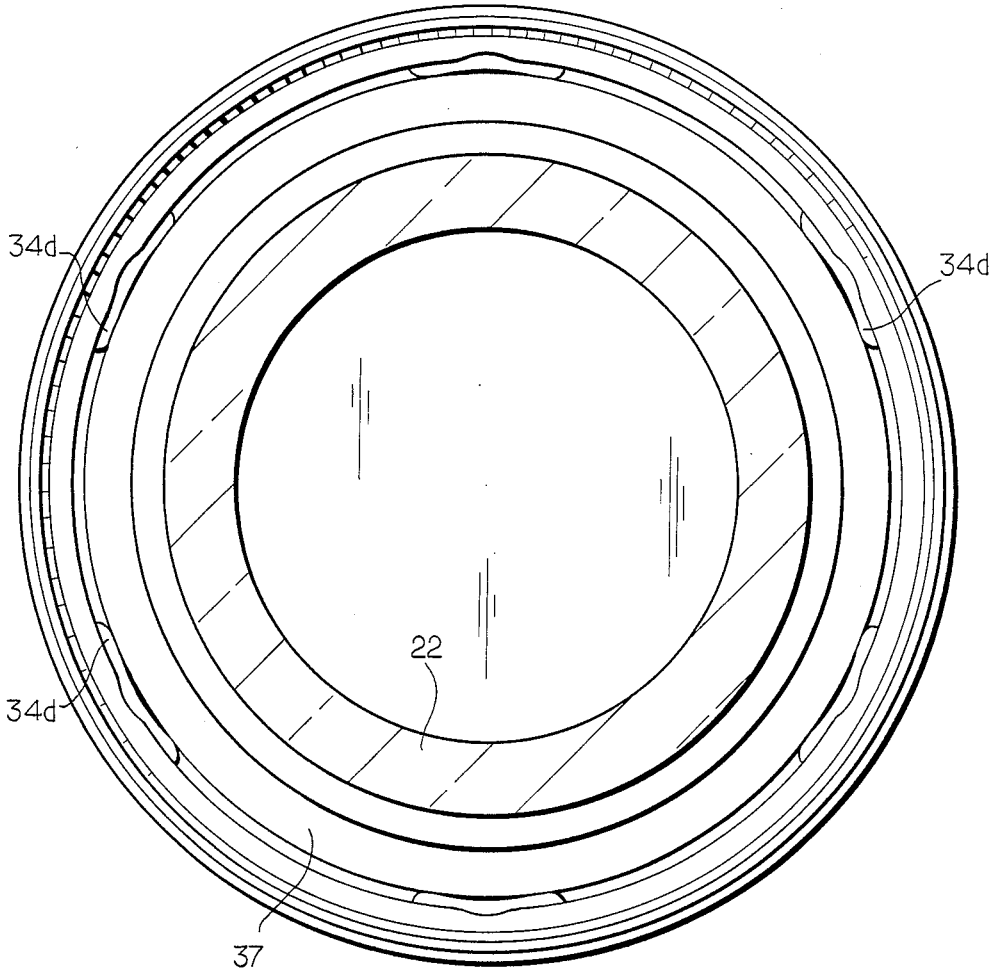
FIG. 17 is a sectional view taken along the line 17—17 in FIG. 13.
Figure 18:
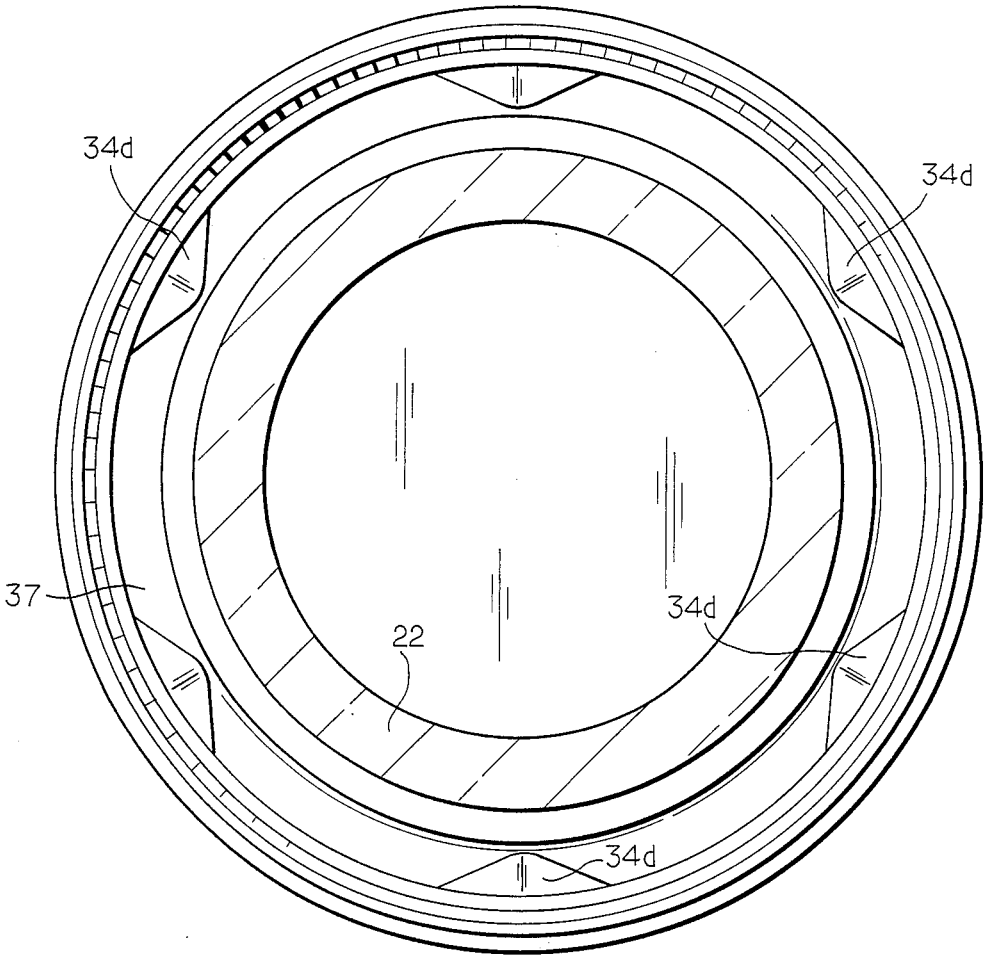
FIG. 18 is a sectional view taken along the line 18—18 in FIG. 14.

When the closure 23*b* is applied as shown in FIGS. 13 and 17, the wall 30*a* is deformed so that it extends generally axially along the inner surface of the skirt and the flexible walls 34*d* are deflected radially outwardly intermediate their ends by the annular bead 37, over annular bead 37 on the finish 22. As the closure 23*b* is threaded on the container, the flexible walls 34*d* pass over the bead and flex radially inwardly beneath the bead 37 while the wall 30*a* remains interposed between the neck 22 and the inner surface of the skirt 25 as shown in FIGS. 14 and 18.

In this form, the height of wall 30*a* is greater than in the other forms such that wall 30*a* remains interposed between the bead 37 and skirt 25.

Figure 19:
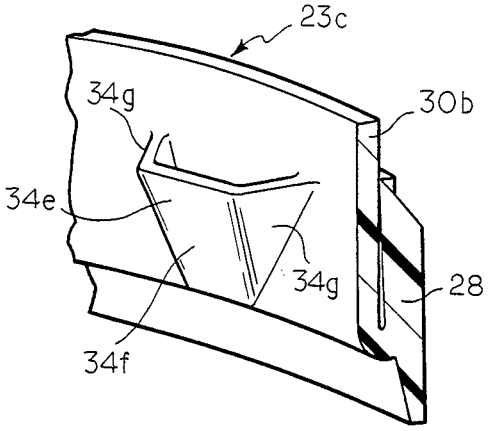
FIG. 19 is a fragmentary sectional view of a further form of closure.
Figure 12:
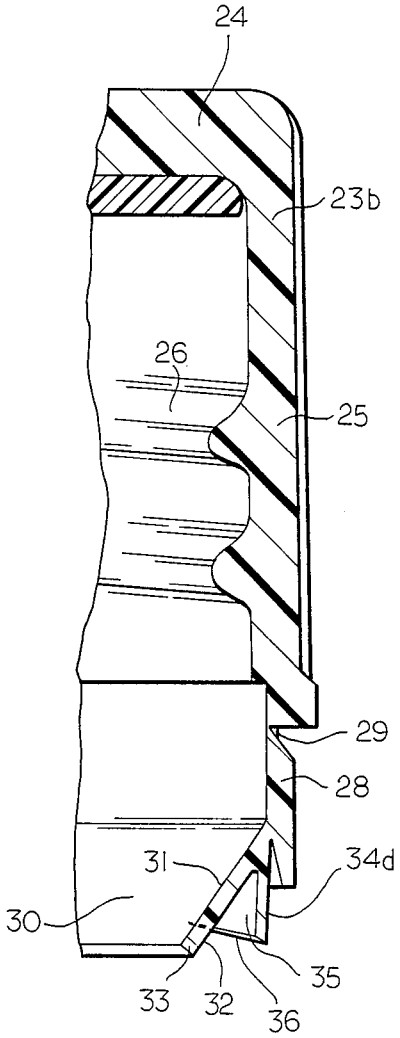
FIG. 12 is a vertical sectional view of a modified form of closure before reshaping.

On the form of closure 23*b* shown in FIG. 19, the wall 34*e* comprises a circumferentially extending portion 34*f* and end portions 34*g* which extend from portion 34*f* at an obtuse angle to wall 30*b*. Otherwise, the closure is like that shown in FIGS. 12–18.

It can thus be seen that there has been provided a closure which will accommodate wide tolerances and which can not be readily defeated.

I claim:

1. A tamper-indicating closure adapted for attachment on a container having a finish disposed about a mouth opening and an external annular bead below said finish comprising, a one-piece molded closure of plastic and having a base and peripheral skirt, said closure having means thereon adapted to interengage means on the container, a tamper-indicating band joined to the skirt of the closure along a weakened frangible line, a flexible annular first wall formed within the band providing an inner annular surface and extending inwardly and upwardly when the closure is applied to the container finish, said band including a plurality of circumferentially spaced flexible second walls extending circumferentially and fastened at their circumferential ends to the inner surface of said annular first wall, said second wall having portions intermediate their ends extending radially inwardly such that when the closure is applied to the container finish, said second walls are flexed radially outwardly over said annular bead and then flex radially inwardly beneath the annular bead while said first annular wall is interposed between the skirt of the closure and said annular bead, and when the applied closure is removed from the container finish, the edges of said second walls nearest the base of the closure skirt at said weakened line engage the underside of said bead and cause the band to sever along said weakened line.

2. The closure set forth in claim 1 wherein each of said plural second walls is connected to said annular first wall near the lower edge thereof.

3. The closure set forth in claim 2 wherein the said lower edge of each of the plural second walls extends transversely in a radial plane to said annular first wall.

4. The closure set forth in claim 1 wherein said flexible annular wall includes slots extending from the free edge thereof toward said band.

5. The closure set forth in any of claim 1-4 wherein said interengaging means comprise interengaging threads.

6. The closure set forth in claim 2 wherein each of said second wall portions comprise a circumferential center portion and end portions extending from the center portion to said annular first wall.

7. The closure set forth in claim 6 wherein said end portions extend axially and radially.

8. The closure set forth in claim 6 wherein said end portions form an obtuse angle with said circumferential portion.

9. The closure set forth in claim 2 wherein said second circumferentialy extending walls are V-shaped in transverse cross section.

10. The closure set forth in claim 2 wherein said flexible second walls are curved in transverse cross section.

11. A tamper-indicating package comprising a one-piece molded closure of plastic, a container, said closure and container having complementary interengaging means for applying and removing the closure on the container, said container including an annular external bead below its said interengaging means, a tamper-indicating band joined to the skirt of the closure along a weakened frangible line, a flexible annular first wall formed within the band and extending inwardly and upwardly when the closure is applied to the container, said band including a plurality of circumferentially spaced flexible second walls extending circumferentially and fastened at their circumferential ends to the inner surface of said annular first wall, said plural second walls each having a portion intermediate its ends extending radially inwardly such that when the closure is applied to the container, the circumferentially extending walls are flexed radially outwardly over said annular bead of the container and then flex radially inwardly beneath said annular bead while the annular wall is interposed between the skirt of the closure and said annular bead, and when the closure is removed,the upper edges of said second walls engage the underside of said annular bead and cause the band to sever along the weakened line.

12. The package set forth in claim 11 wherein each of said plural second walls are connected to the annular first wall along the lower edge thereof.

13. The package set forth in claim 11 wherein the lower edge of each of said plural second walls extends transversely in a radial plane.

14. The package set forth in claim 11 wherein said flexible annular first wall includes slots extending from the free edge thereof toward said band.

15. The package set forth in claim 11 wherein said interengaging means comprise interengaging threads.

16. The package set forth in claim 12 wherein each of said second walls comprises a circumferential center portion and end portions extending from the center portion to said annular first wall.

17. The closure set forth in claim 16 wherein said end portions extend axially and radially.

18. The closure set forth in claim 16 wherein said end portions form an obtuse angle with said circumferential center portion.

19. The closure set forth in claim 12 wherein the plural circumferentially extending second wall portions are each V-shaped in their transverse cross section.

20. The closure set forth in claim 12 wherein the plural second wall portions are each curved in their transverse cross section.

21. The closure set forth in claim 2 wherein said annular first wall includes slots extending from the inner edge thereof toward said band.

22. A one piece tamper indicating plastic closure adapted for attachment on a container having an external annular bead comprising:

a base and integral peripheral skirt, means on said skirt adapted to interengage and attach the closure on the container, a tamper indicating band integrally joined to said skirt by annular weakened frangible means, a separate flexible annular wall means connected along the lower end of said band and disposed in the interior of said band extending inwardly and upwardly toward said base, said wall means having plural flexible annular wall segments integrally connected thereon in spaced apart and circumferentially arranged relationship and disposed innermost of said wall means, each of said segments being joined to the wall means at their opposite ends to define a radially inwardly open pocket having a free upper edge spaced inwardly from said wall means, the pockets being spaced circumferentially along the inside of the band, said wall segments being flexible outwardly to collapse the pockets as they pass over said container bead upon attaching the closure on said container and flexible inwardly to normally open said pockets, whereby the upper free edges of said open pockets engage the underside of said bead and cause the band to separate from the skirt along the annular weakened frangible means during removal of the closure from the container.

23. The closure set forth in claim 22 wherein the said plural annular wall segments are each joined to the said wall means along their lower edge.

24. The closure set forth in claim 23 wherein the said annular wall segments are each joined to the flexible annular wall means at their opposite ends by a portion which extends radially outwardly to said annular wall means.

* * * * *